US006705652B2

(12) United States Patent
Engel

(10) Patent No.: US 6,705,652 B2
(45) Date of Patent: Mar. 16, 2004

(54) SECURITY SYSTEM

(76) Inventor: Arnold Richard Engel, 7660 Timberrose Way, Roseville, CA (US) 95747

( * ) Notice: Subject to any disclaimer, the term of this patent is extended or adjusted under 35 U.S.C. 154(b) by 0 days.

(21) Appl. No.: 10/180,907

(22) Filed: Jun. 25, 2002

(65) Prior Publication Data

US 2003/0234546 A1 Dec. 25, 2003

(51) Int. Cl.[7] ..... E05C 19/18
(52) U.S. Cl. ..... 292/259 R; 292/289; 292/339
(58) Field of Search ..... 292/259 R, 289, 292/260, 262, 264, 338, 339; 70/30, 49, 93, 94

(56) References Cited

U.S. PATENT DOCUMENTS

| | | | | | |
|---|---|---|---|---|---|
| 482,227 | A | | 9/1892 | Conner | |
| 795,712 | A | * | 7/1905 | Kupsch | 292/259 R |
| 1,496,793 | A | | 6/1924 | Unger | |
| 2,908,529 | A | | 10/1959 | Davidson | |
| 3,059,952 | A | | 10/1962 | Wittman | |
| 3,140,795 | A | | 7/1964 | Griffith | |
| 4,067,598 | A | | 1/1978 | Mansour | |
| 4,429,911 | A | | 2/1984 | O'Neal | |
| 4,560,191 | A | | 12/1985 | Grassi | |
| 4,601,503 | A | | 7/1986 | Wicks, Sr. | |
| 4,889,372 | A | | 12/1989 | Dege | |
| 4,974,889 | A | | 12/1990 | North | |
| 5,282,656 | A | | 2/1994 | Fizer | |
| 5,466,023 | A | * | 11/1995 | Williamson | 292/259 R |
| 5,490,304 | A | * | 2/1996 | Winner et al. | 16/82 |
| 5,573,289 | A | * | 11/1996 | Littlefair | 292/264 |
| 5,772,266 | A | * | 6/1998 | Skiba | 292/259 R |
| 5,899,509 | A | * | 5/1999 | Ferguson et al. | 292/259 R |

FOREIGN PATENT DOCUMENTS

| | | | | |
|---|---|---|---|---|
| GB | 2263500 A | * | 7/1993 | E05C/19/00 |

* cited by examiner

*Primary Examiner*—Robert J. Sandy
*Assistant Examiner*—Thomas Ho
(74) *Attorney, Agent, or Firm*—Tod R. Nissle, P.C.

(57) ABSTRACT

A door security system utilizes a bar that spans the distance across a door and prevents the door from being opened. The bar combines an elastic, flexible hollow rod with a cable that is pliable but generally does not flex. The bar flexes when an individual attempts to force open the door against the bar. When the bar flexes it generates a force that acts to close the door.

2 Claims, 2 Drawing Sheets

FIG. 1
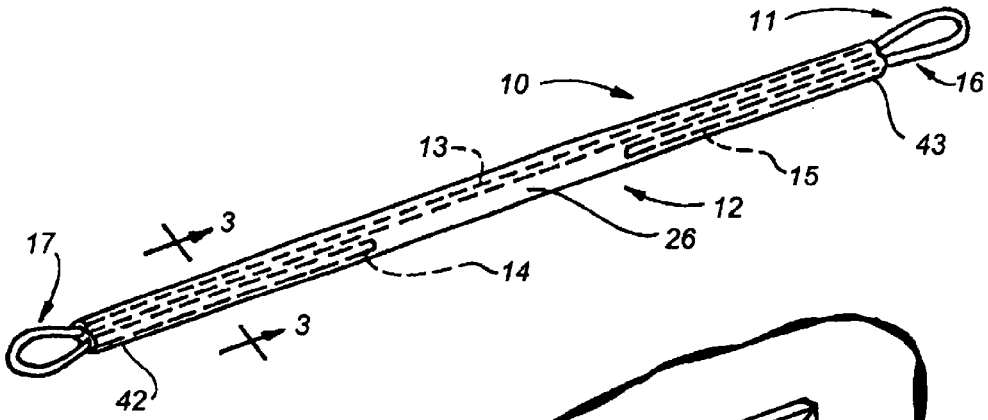
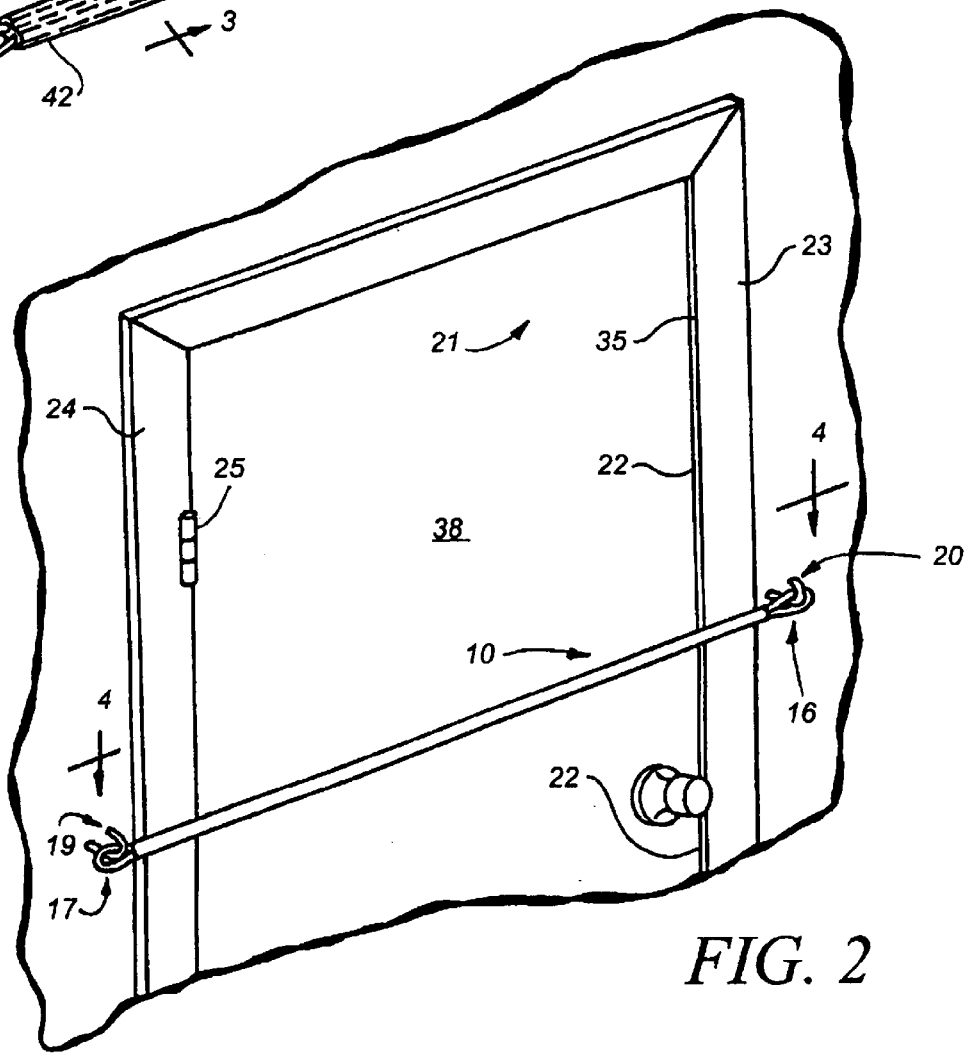
FIG. 2

SECURITY SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention pertains to security systems.

More particularly, the invention pertains to a system for securing a door used to access a room.

In a further respect, the invention pertains to a security system that spans a door to a room and permits the door to be opened to a slightly ajar position to engage the security system without permitting the door to be opened an amount sufficient to see into or out of the room.

(2) Description of related Art including information disclosed under 37 CFR 1.97 and 1.98.

A variety of systems for securing a door are known in the art. U.S. Pat. No. 4,974,889 describes a fixed length cable that spans a door. The ends of the cable are secured on either side of the door such that the cable prevents the door from being opened. The cable is provided with sufficient slack to permit the door to be opened so the occupant of a room can view the person at the door.

U.S. Pat. No. 5,282,656 to Fizer discloses a telescoping door bar that spans a door. The ends of the telescoping bar are secured on either side of the door such that the telescoping bar prevents the door from being opened. The door can be opened far enough, however, or "cracked" so that a person can look between the door and the door jamb.

U.S. Pat. No. 4,429,911 to O'Neal et al. discloses a door bar that spans a door. The ends of the bar are secured on either side of the door such that the telescoping bar prevents the door from being opened. The door can be opened far enough, however, or "cracked" so that a person can look between the door and the door jamb.

U.S. Pat. No. 4,067,598 to Mansour discloses a door bar that spans a door. The ends of the bar are secured on either side of the door such that the bar prevents the door from being opened. A spacer clip 70 is positioned intermediate the door and the bar to prevent the door from being opened.

U.S. Pat. No. 4,601,503 to Wicks, Sr. discloses a door bar that spans a door. The ends of the bar are secured on either side of the door such that the bar prevents the door from being opened.

One apparent disadvantage of the prior art security systems described above is that they appear to allow, unless a spacer is interposed between a bar and the door in the manner shown in the Mansour patent (U.S. Pat. No. 4,067,598), the door to be opened an amount sufficient for the individual opening the door to see into the room. If the individual can see into the room, he can determine visually the location of the security bar on the door and can attempt to cut or break the bar.

Another disadvantage of existing security systems is that they sometimes anchor supports into the molding and/or door jamb. Molding typically is not structurally strong, nor are door jambs.

A further disadvantage of existing security systems is that when a bar is secured to either side of the molding, the bar is spaced away from the molding, increasing the distance a door can be opened before the door contacts the molding.

Another disadvantage of existing security systems is that while the systems block or prevent movement of a door when the door is opened, the systems do not appear to develop a positive counteracting force that tends to push a door closed.

Accordingly, it would be highly desirable to provide a door security system which would prevent a door from being cracked without requiring the use of a spacer of the type disclosed in U.S. Pat. No. 4,067,598, which would not require that a bar be anchored in the door jamb or molding, and which would generate a positive counteracting force that would act to force a door back to a closed position.

Therefore, it is a principal object of the invention to provide an improved security system for a door.

Another object of the invention is to provide an improved door security system of the type including a bar that spans a door and is affixed at either end to prevent the door from being opened.

A further object of the invention is to provide an improved door security bar system of the type described which generates a force acting to close the door.

Still another object of the invention is to provide an improved door security bar system of the type described which prevents a person attempting to gain entry into a room from being able to see past a door into the room when the person attempts to force the door open.

BRIEF DESCRIPTION OF THE SEVERAL VIEWS OF THE DRAWING(S)

These and other, further and more specific objects and advantages of the invention will be apparent to those skilled in the art from the following detailed description thereof, taken in conjunction with the drawings, in which:

FIG. 1 is perspective view illustrating the novel metal sleeve—cable construction utilized in the invention;

FIG. 2 is a perspective view illustrating the door security system of the invention;

BRIEF SUMMARY OF THE INVENTION

Figure 3:
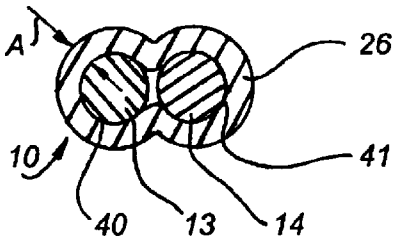
FIG. 3 is a section view further illustrating details of the construction of FIG. 1 and taken along section lines 3—3 thereof.

Briefly, in accordance with the invention, I provide an improved security system. The security system includes apparatus defining a door opening for a room. The apparatus includes at least a pair of vertically oriented spaced apart support members, a door jamb intermediate the support members, and a pair of vertically oriented molding members each adjacent and extending outwardly from the door jamb. The security system also includes a door coupled to the door jamb for opening and closing the opening; a hollow substantially rigid flexible metal rod spanning the door opening and having a pair of opposing ends; at least one cable extending into the metal rod; and, two fixing members each secured to a different one of the support members. The cable and rod are securable at each end of the rod to one of the fixing members such that the rod contacts each of said molding members so that the door can be moved from a closed position to a slightly ajar position in which the door engages and flexes the bar without permitting a person at the door to view through the opening the room and the rod. The flexed bar generates a force against the door acting to displace the door to the closed position.

In another embodiment of the invention, I provide an improved method for securing a doorway to a room. The doorway includes a door opening for the room. The door opening includes at least a pair of vertically oriented spaced apart support members; a door jamb intermediate the support members; a pair of vertically oriented molding members each adjacent and extending outwardly from the doorjamb; and, a door coupled to the door jamb for opening and closing the opening. The method includes the steps of providing a security system including a hollow substantially rigid flexible metal rod spanning the door opening and having a pair of opposing ends; at least one cable extending into said metal rod; and, two fixing members. The cable and rod being securable at each end of the rod to one of the fixing members. The method also includes the steps of installing one of the fixing members adjacent one of the molding members and extending into one of the support members; installing the other of the fixing members adjacent the other of the molding members and extending into the other of the support members; and, securing each end of the rod to a different one of the fixing members such that the rod contacts each of the molding members so that the door can be moved from a closed position to a slightly ajar position in which the door engages and flexes the bar without permitting a person at the door to view through the opening the room and the rod. The flexed bar generates a force against the door acting to displace the door to the closed position.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a security bar used in the security system of the invention and generally indicated by reference character 10. Bar 10 includes a hollow substantially rigid flexible rod 12. While the material utilized to fabricate rod 12 can vary, metal is presently preferred. Rod 12 presently consists of extruded aluminum. A pliable cable 11 extends into rod 12. The construction of cable 11 can vary as desired. Cable 11 presently consists of 3/16 inch diameter 7×19 aircraft cable. Cable 11, while pliable, has little elasticity and can not flex.

As used herein, a material has the ability to flex if the material, when bent or compressed, elastically attempts to return to its normal configuration. If the ends of a straight substantially rigid elastic rubber rod are held and the ends of the rod are displaced such that the rod takes on a curved or bowed shape, forces are developed which act to return the rod to its normal straight configuration. Consequently, the rubber rod is elastic and can be flexed. One advantage of the invention is that it combines in a security bar 10 a length of substantially rigid flexible metal rod with a length of strong pliable cable. Regardless of whether the cable is flexible (and the presently preferred cable does not have any significant flexibility) the combination of the cable and metal rod produces an unusually strong, but flexible, structural member that not only resists shear forces but also, as will be described below, generates a force F4 that acts to return a door to a closed position.

Figure 5:
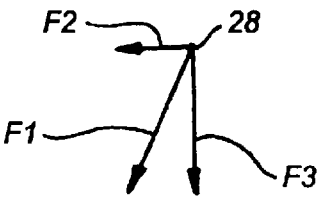
FIG. 5 is a force vector diagram illustrating the forces generated by a door on the metal sleeve—cable construction; and, FIG. 6 is a force vector diagram illustrating the force generated by the metal sleeve-cable construction on a door to displace the door back toward the closed position.

The width, indicated by arrows A in FIG. 5, of the wall of rod 12 can vary as desired, but is presently 3/16 inch and is preferably in the range of about 1/16 inch to 1/2 inch.

Cable 11 is threaded through adjacent cylindrical openings 40 and 41 formed in rod 12. Openings 40 and 41 have a diameter that is about 0.0005 to 0.005 inch greater than the outside diameter of cable 11 so that cable 11 slides snugly into openings 40 and 41. A single length of cable 11 is presently preferred, with each end 14, 15 of the cable inserted in opening 41 in the manner shown in FIG. 1 to form loops 16, 17. Each loop is at one end 42, 43 of rod 12. The intermediate portion 13 of cable 11 extends through opening 40 of rod 12.

Cable 11 is doubled over on itself both to form loops 16 and 17 and to insure that a pair of parallel lengths 13 and 15 of cable each extend through one of openings 40 and 41 adjacent the point 28 at which a door edge 22 will bear against bar 10. Cable lengths 13 and 15 significantly increase the strength of bar 12, especially when bar 12 is oriented in the manner shown in FIG. 4 with the parallel cable lengths 13 and 15 not stacked one on top of the other lying in a vertically oriented plane, but instead oriented side-by-side lying in a generally horizontally oriented plane. In the configuration illustration in FIG. 4, cable length 13 is closer to edge 22 than cable length 15.

A first length of cable can be used to make loop 16. A second length of cable can be used to make loop 17, where the first and second lengths of cable are not attached to one another, but are separate from one another. Or, a length of cable can be utilized that extends only through opening 40 (or 41), so there is not any cable in opening 41 (or 40). The number of pieces of cable used to fabricate bar 10 and the length of each piece of cable can vary as desired. A clip of other fastening means can be secured to the end of rod 12 or to the ends of cable 11 and used to fasten bar 10 to hook 19, 20 instead of using loops 16 and 17. Fastening means other than hooks 19 and 20 and loops 16 and 17 can be utilized to secure bar 10 in place adjacent a door 21.

Hooks 19, 20 presently include externally threaded wood screw ends that are turned into a king stud 36, 38 or jack stud 37, 39. As noted, any desired fastening means other than hooks 19, 20 can be utilized to secure the ends of bar 10 in place. Hooks 19, 20 are positioned to receive loops 16 and 17 in the manner illustrated in FIGS. 2 and 4 such that bar 10 is adjacent or preferably bears against and contacts molding members 23 and 24.

Figure 4:
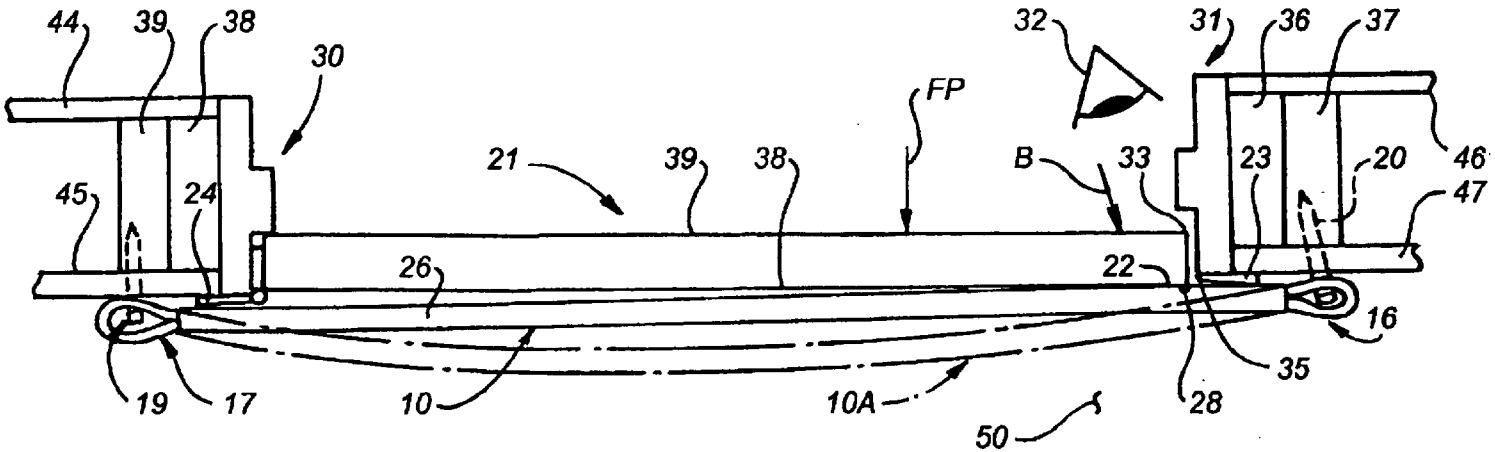
FIG. 4 is a section view further illustrating the door security system of FIG. 2 and mode of operation thereof and taken along section lines 4—4 thereof.
Figure 6:
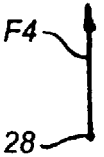

As shown in FIGS. 2 and 4, the door opening includes vertically oriented jack studs 39 and 37, vertically oriented king studs 36 and 38, vertically oriented molding strips 23 and 24, a doorjamb mounted intermediate king studs 36 and 38 and including vertically oriented members 30 and 31, and sheet rock or other wall panels, boards, coverings, etc. 44, 45, 46, 47. Door 21 is hung on hinges 25 in the door opening on member 30. Door 21 includes front rectangular surface 38 and rear rectangular surface 39. Surface 38 is parallel to surface 39.

Door 21 includes front vertically oriented edge 22 and back vertically oriented edge 33. Edges 22 and 33 are parallel.

As illustrated in FIG. 4, when the security bar 10 is installed with loops 16 and 17 secured to hooks 19 and 20, bar 10 preferably rests against a portion of each of molding strips or members 23 and 24. Member 23 includes vertically oriented edge 35.

When door 21 is opened in the direction of arrow B, edge 22 contacts bar 10 at point 28. If a force F1 of at least about ten pounds per square inch is applied to door 21 when edge 22 contacts bar 10, then bar 10 bows, or flexes, in the manner indicated by ghost outline 10A. When bar 10 flexes, a force F4 is generated by bar 10 against edge 22 of door 21 as bar 10 attempts to elastically return to its normal linear configuration illustrated in FIG. 1 and indicated in FIG. 4 by reference character 10. While the force F1 that needs to be applied to point 28 on bar 10 by edge 22 to cause bar 10 to flex can vary as desired, it is presently preferred that the force be at least ten pounds per square inch. The flexing of bar 10 to produce force F4 is important in the practice of the invention because force F4 actively opposes an individual attempting to force door open 21 in the direction of arrow B. In contrast, if bar 10 is perfectly rigid and does not flex, bar 10 prevents door 21 from opening but does not generate a force that functions to close door 21 in a direction opposite the direction indicated by arrow B.

When door 21 is pressed against bar 10 in the direction of arrow B, a force F1 is generated. F1 includes a component F2 acting in a direction generally parallel to bar 10 and a component F3 acting in a direction generally perpendicular to bar 10. When the magnitude of component F3 is great enough, bar 10 flexes, or bows, in the manner indicated by dashed lines 10A. The magnitude of F3 necessary to flex bar 10 can vary in accordance with the construction of bar 10 but presently the force F3 necessary to flex bar 10 is at least ten pounds per square inch.

In the practice of the invention, hooks 19 and 20 are installed so that bar 10 is, when mounted on hooks 19 and 20, positioned in contact with, or sufficiently near, molding members 23 and 24 to prevent door 21 from opening far enough in the direction of arrow B to enable an individual to view 32 between edge 33 and edge 35 into room 50. Preventing an individual from being able to see between edge 33 and edge 35 also prevents an individual from visually identifying the location at which bar 10 spans the distance from edge 22 to molding piece 23, which makes it more difficult for the individual to cut or otherwise disable bar 10 and gain entry into room 50.

Having described my invention in such terms as to enable those of skill in the art to make and practice it, and having described the presently preferred embodiments thereof, I claim:

1. A security system including (a) means defining (i) a door opening to a room including at least a pair of vertically oriented spaced apart support members, a door jamb intermediate said support members, a pair of vertically oriented molding members each adjacent and extending outwardly from said door jamb, and (ii) a door coupled to said door jamb for opening and closing said door opening;

(b) a hollow substantially rigid flexible metal rod spanning said door opening and having a pair of opposing ends;

(c) at least one cable extending into said metal rod;

(d) two fixing means each secured to a different one of said support members;

said cable and rod being securable at each end of said rod to one of said fixing means such that (e) said rod contacts each of said molding members so that said door can be moved from a closed position to a slightly ajar position in which said door engages and bends and flexes said bar without permitting a person at the door to view through the opening the room and said rod, said bent flexed bar generating a force against said door acting to displace said door to said closed position.

2. A method for securing a doorway to a room, the doorway including means defining a door opening to the room and including at least a pair of vertically oriented spaced apart support members, a door jamb intermediate said support members, a pair of vertically oriented molding members each adjacent and extending outwardly from said door jamb, and a door coupled to said door jamb for opening and closing said door opening;

the method including the steps of (a) providing a security system including (i) a hollow substantially rigid flexible metal rod spanning said door opening and having a pair of opposing ends, (ii) at least one cable extending into said metal rod;

(iii) two fixing means, said cable and rod being securable at each end of said rod to one of said fixing means;

(b) installing one of said fixing means adjacent one of said molding members and extending into one of said support members;

(c) installing the other of said fixing means adjacent the other of said molding members and extending into the other of said support members;

(d) securing each end of said rod to a different one of said fixing means such that said rod contacts each of said molding members so that said door can be moved from a closed position to a slightly ajar position in which said door engages and bends and flexes said bar without permitting a person at the door to view through the opening the room and said rod, said bent flexed bar generating a force against said door acting to displace said door to said closed position.

* * * * *